US011225953B2

(12) United States Patent
Van Opdorp et al.

(10) Patent No.: US 11,225,953 B2
(45) Date of Patent: Jan. 18, 2022

(54) INJECTION ASSEMBLY, INJECTION PUMP, AND METHOD FOR SUPPLY OF ADDITIVE TO A FLUID IN A PIPE

(71) Applicants: Robertus Martinus Van Opdorp, Amsterdam (NL); Willem Ten Kate, Ommen (NL)

(72) Inventors: Robertus Martinus Van Opdorp, Amsterdam (NL); Willem Ten Kate, Ommen (NL); Martijn De Boer, Broek op Langedijk (NL)

(73) Assignees: Robertus Martinus Van Opdorp, Amsterdam (NL); Willem Ten Kate, Ommen (NL)

( * ) Notice: Subject to any disclaimer, the term of this patent is extended or adjusted under 35 U.S.C. 154(b) by 102 days.

(21) Appl. No.: 16/326,310

(22) PCT Filed: Aug. 22, 2017

(86) PCT No.: PCT/NL2017/050549
§ 371 (c)(1),
(2) Date: Feb. 18, 2019

(87) PCT Pub. No.: WO2018/038605
PCT Pub. Date: Mar. 1, 2018

(65) Prior Publication Data

US 2019/0186476 A1 Jun. 20, 2019

(30) Foreign Application Priority Data

Aug. 23, 2016 (NL) ..... 1042015

(51) Int. Cl.
*F04B 17/04* (2006.01)
*F04B 53/12* (2006.01)
(Continued)

(52) U.S. Cl.
CPC ..... *F04B 17/048* (2013.01); *B01F 15/0412* (2013.01); *F04B 5/02* (2013.01); *F04B 17/046* (2013.01); *F04B 53/126* (2013.01)

(58) Field of Classification Search
CPC ..... F04B 17/046; F04B 5/02; F04B 53/125; F04B 53/126; F04B 53/048; F04B 17/048;
(Continued)

(56) References Cited

U.S. PATENT DOCUMENTS 2,441,259 A 5/1948 Cook
3,403,627 A 10/1968 Grimshaw
(Continued)

FOREIGN PATENT DOCUMENTS

DE 3132897 A1 3/1983
DE 1239420 A1 6/1993
(Continued)

OTHER PUBLICATIONS

European Communication Pursuant to Article 94(3) EPC dated Feb. 24, 2020, corresponding to Application No. 17758305.1.
(Continued)

*Primary Examiner* — Charles G Freay
(74) *Attorney, Agent, or Firm* — Patterson & Sheridan, L.L.P.

(57) ABSTRACT

An injection assembly configured to supply an additive from a reservoir to a fluid in a pipe has a pipe portion and an injection pump. The injection pump has a linear motor comprising a stator and an armature reciprocatingly driven by the stator, and a pump portion comprising an additive inlet chamber. A piston coupled to the armature is configured to reciprocate in said inlet chamber, thereby alternatingly compressing and decompressing a volume of said inlet chamber, an additive outlet chamber in fluid communication
(Continued)

Figure 1:
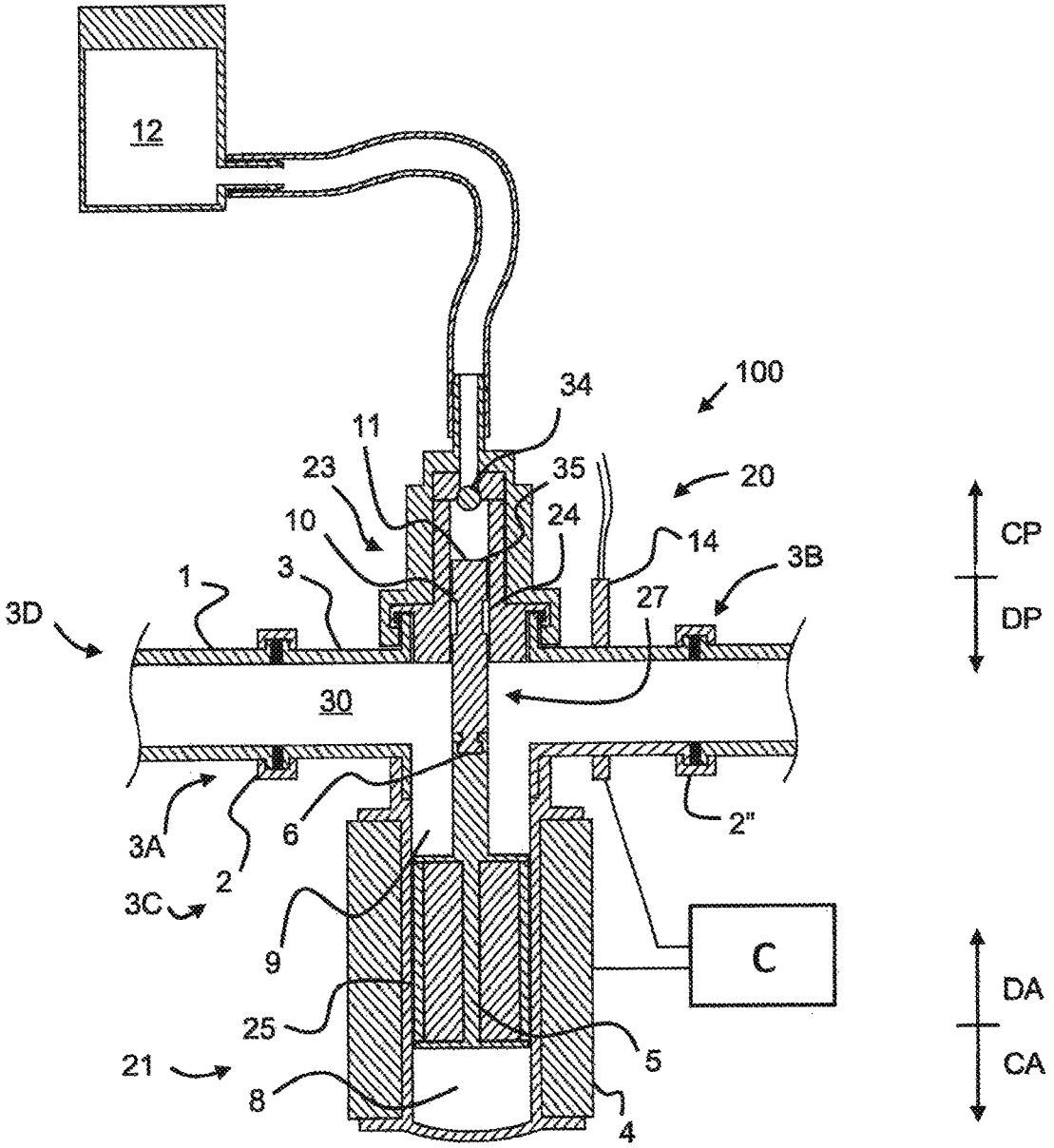

with the pipe portion, and a bypass channel between the inlet and outlet chambers.

15 Claims, 4 Drawing Sheets

(51) Int. Cl.
*B01F 15/04* (2006.01)
*F04B 5/02* (2006.01)

(58) Field of Classification Search
CPC ..... F16K 15/044; F16K 15/046; Y10T 137/2514; B01F 15/0412
See application file for complete search history.

(56) References Cited

U.S. PATENT DOCUMENTS

| | | | | |
|---|---|---|---|---|
| 3,556,684 | A * | 1/1971 | Rouquette | F04B 17/046 417/307 |
| 3,621,865 | A * | 11/1971 | Baggaley | A01M 7/0092 137/101.21 |
| 4,314,797 | A * | 2/1982 | Gerwin | F04B 15/06 417/418 |
| 6,009,953 | A * | 1/2000 | Laskaris | A62C 5/02 169/13 |
| 6,766,863 | B2 * | 7/2004 | Arvidson | A62C 5/02 169/13 |
| 6,981,848 | B1 | 1/2006 | Cessac | |
| 2002/0048517 | A1 | 4/2002 | Sugita et al. | |
| 2006/0204376 | A1 | 9/2006 | Walton | |
| 2008/0302710 | A1 | 12/2008 | Zhang et al. | |
| 2015/0128811 | A1 | 5/2015 | Durairajasivam et al. | |
| 2019/0112959 | A1 * | 4/2019 | Xi | F04B 53/1005 |

FOREIGN PATENT DOCUMENTS

| | | | |
|---|---|---|---|
| EP | 0161614 | A2 | 11/1985 |
| EP | 0203222 | A1 | 12/1986 |
| EP | 0459434 | A2 | 12/1991 |
| FR | 2210285 | * | 6/1974 |
| NZ | 240660 | A | 1/1996 |

OTHER PUBLICATIONS

International Search Report and Written Opinion dated Nov. 3, 2017 for Application No. PCT/NL2017/050549.
Search Report dated Feb. 10, 2017 for Application No. NL 1042015.

* cited by examiner

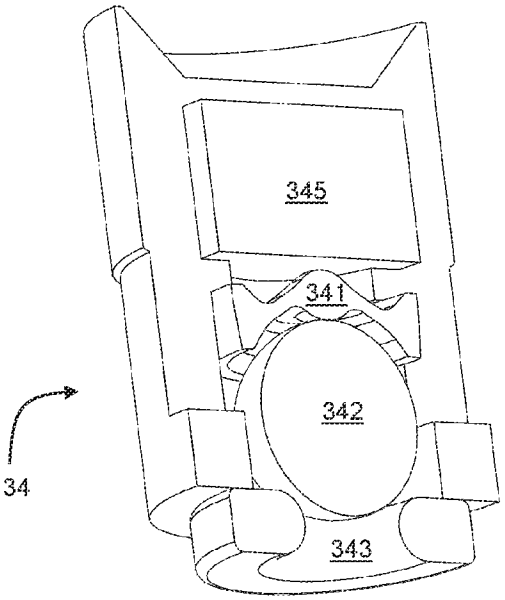
FIG. 4A
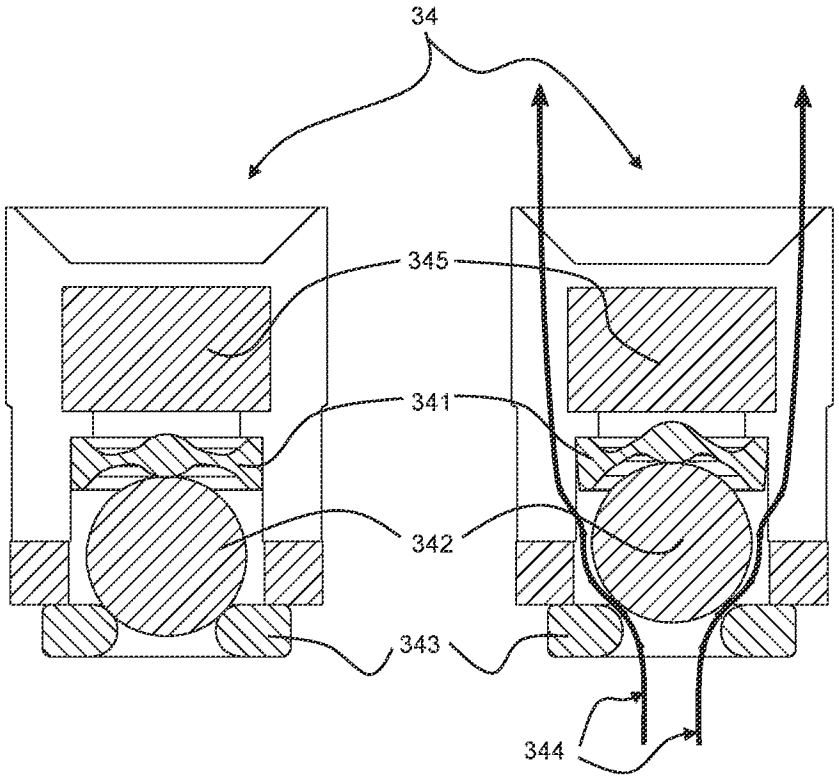
FIG. 4C
FIG. 4B

INJECTION ASSEMBLY, INJECTION PUMP, AND METHOD FOR SUPPLY OF ADDITIVE TO A FLUID IN A PIPE

The present invention relates to the field of an injection assembly configured to supply a predetermined amount of an additive from a reservoir to a fluid in a pipe, for example an existing pipe. The invention further relates to an injection pump forming part of the injection assembly. The invention also relates to a method for the supply of a predetermined amount of additive from a reservoir to a fluid in the pipe.

Known injection assemblies for the supply of a predetermined amount of an additive from a reservoir to a fluid in a pipe, such as an existing pipe, for example the device for the dosage of liquids known from NL6817544, comprise a pipe with a locally widened portion, a dosage housing, a reservoir, a pump, and a tube connecting the dosage housing with the widened portion of the pipe. In use, the pump pumps a liquid from the reservoir into the dosage housing. Consecutively, the liquid is drained from the dosage housing to the pipe through the tube.

A disadvantage of such an injection assembly is that it requires a lot of space relative to the diameter of the pipe, which makes them unsuited for use in a dense maze of pipes.

A further disadvantage of such injection assemblies is that the amount of fluid introduced in the pipe cannot satisfactorily be controlled, as the fluid is first pumped to a dosage housing, and then from the dosage housing into a widened portion of the pipe. A constant supply of fluid towards an outlet of the widened pipe portion cannot be guaranteed.

US2015/0128811 discloses a nutrient infuser comprising a pump, an inlet, an outlet, and a canister. The outlet is inserted through the sidewalls of a pipe, extending into hollow space within the pipe. The pump pumps the nutrient from the canister, through respectively the inlet, the pump, and the outlet, into the pipe.

A disadvantage of such a nutrient infuser is that the amount of nutrient supplied to the pipe cannot be satisfactorily controlled.

A further disadvantage is that the nutrient infuser is unsuited for nutrients that are relatively aggressive and/or easily corrode an inlet and/or outlet tubing when these nutrients are infused in a relatively pure concentration.

It is an aim of the present invention to provide an improved injection assembly. More specifically, it is an object of the present invention to at least partially overcome one or more of the above-mentioned disadvantages.

In a first aspect, the present invention provides an injection assembly configured to supply a predetermined amount of an additive from a reservoir to a fluid in a pipe, the injection assembly comprising:

- a pipe portion comprising a first end and an opposite second end, which pipe portion is configured to be coupled in line with the pipe;
- two fluid-tight couplings, arranged to respectively couple the first end and the second end of the pipe portion to the pipe in a fluid-tight manner; and
- an injection pump comprising:
  - an electromagnetic linear motor comprising a stator and a movable armature that is configured to be driven reciprocatingly with respect to the stator,
  - a pump portion comprising a piston and an additive inlet chamber, wherein the piston is coupled to the armature, and is configured to reciprocate in said additive inlet chamber, thereby, in use, alternatingly compressing and decompressing a volume of said additive inlet chamber with a compression stroke and decompression stroke, and
  - an additive outlet chamber arranged or arrangable in direct fluid communication with the pipe portion and arranged in fluid communication with the additive inlet chamber;
  - wherein, in use, a first decompression stroke of said piston discharges a predetermined amount of said additive from said reservoir into said additive inlet chamber, a consecutive compression stroke of said piston causes said additive to flow from the additive inlet chamber into the additive outlet chamber, and a consecutive second decompression stroke of said piston causes the additive to be directly injected into the pipe portion from the additive outlet chamber.

The present invention advantageously allows to directly inject an additive in a piping network, in particular an existing piping network. As a result of this direct injection, the amount of additive added to the fluid in the piping network can be precisely controlled.

Advantageously, providing a pipe portion, two fluid-tight couplings, and an injection pump having direct injection into said pipe portion, the assembly effectively replaces a pipe section of an existing pipe, allows for a compact design of the injection assembly, allowing the injection assembly to be installed even in piping networks where there is little room for add-ons such as dosage housings.

Advantageously, an injection assembly where the additive is directly injected into the pipe portion, allows the injection assembly to be used for relatively aggressive additive in relatively pure concentrations, without providing the additives a possibility to corrode or erode parts of the injection assembly.

Advantageously, the injection assembly may be used to inject an additive that is aggressive in a pure concentration, e.g. chlorine dioxide, in a pure concentration into the pipe portion, i.e. the injection assembly advantageously allows to inject aggressive additives into the pipe portion without having to mix them first.

The pipe portion of the injection assembly effectively replaces a pipe section. In embodiments, when installing the injection assembly, an installer will first shut off and possibly empty an existing pipe maze, and then break up an existing pipe by removing, e.g. by cutting out, a pipe section of said existing piping network. The installer will then install the pipe portion in the broken-up piping network, to replace the removed pipe section with the pipe portion of the injection assembly. When the pipe portion is installed in the existing pipe, a fluid may flow from the existing pipe, into the pipe portion of the injection assembly, and out of the pipe portion. Providing a pipe portion as part of the injection assembly, that is installed into the existing piping network, may allow for controlled conditions inside the pipe portion, and a controlled release of additives into the fluid flowing through the pipe portion.

To prevent leakages, the first and second end of the pipe portion are arranged to the existing pipe with fluid-tight couplings. For example, external screw thread may be applied on both remaining pipe ends of the existing pipe and on the ends of the pipe portion, allowing the fluid-tight coupling to be screwed in between the existing pipe and the pipe portion of the injection assembly. However, many other methods of applying a fluid-tight coupling are known, and may be applied within the scope of the present invention.

In embodiments, the linear motor comprises a stator, comprising one or more electric stator windings, at a radially outer side of the linear motor, and a movable armature, e.g.

a radially polarized magnet, or a series of radially polarized magnets arranged on a core of magnetisable material at a radially inner side of the stator. By applying an alternating current to the stator of such a linear motor, a magnetic field is induced to interact with the armature, which armature will be moved back and forth in a reciprocating manner. By controlling the magnitude and the frequency of the current, e.g. with a controller, the motion frequency and the deflection of the armature may be controlled.

In embodiments, a connector may releasably connect the movable armature and the piston. The connector couples the motion of the piston and the armature of the linear motor to each other. In embodiments, the piston and the movable armature may be directly coupled, such that a reciprocating motion of the movable armature drives the piston of the pump portion. In embodiments, the additive outlet chamber may be arranged at a stationary position, outside of the pipe portion, in direct fluid communication with an inner volume of the pipe portion via a passage opening in a wall of said pipe portion. In other embodiments, the additive outlet chamber may be movably arranged in the injection assembly, wherein a first position of the additive outlet chamber allows a direct fluid communication between the additive outlet chamber and the pipe portion, and wherein the additive outlet chamber and the pipe portion are physically separated in a second position, without a direct fluid communication between them.

A compression stroke and a decompression stroke are defined for the piston. In operation, multiple strokes of the piston may be required to transfer an amount of additive from a reservoir into a fluid in the pipe portion. For example, for the point of view of the additive, a first decompression stroke of the piston may be required to introduce the additive from the reservoir into the additive inlet chamber. Then, a compression stroke may be required to force the additive from the additive inlet chamber, into the additive outlet chamber. Then a further decompression stroke of the piston may be required to force the additive from the additive outlet chamber into the pipe portion From the point of view of the piston, after a decompression stroke, when the additive inlet chamber may be filled with additive, and the additive outlet chamber may be emptied of additive, a compression stroke may force additive from the additive inlet chamber to the additive outlet chamber. After this compression stroke, when the additive inlet chamber is emptied of additive and the additive outlet chamber is filled with additive, a decompression stroke of the piston, may simultaneously introduce an additive into the additive inlet chamber, filling the additive inlet chamber, and introduce additive from the additive outlet chamber into the pipe portion, emptying the additive outlet chamber.

It is noted that, although the above texts states that the additive outlet chamber may be emptied of additive after a decompression stroke, respectively that the additive outlet chamber may be emptied of additive after a compression stroke, this does not require that said chamber is fully empty, after said stroke. In a realistic embodiment, there is always some, or even quite some additive present in either one of the chambers, depending on their relative size, once the injection assembly is operative. The word 'emptied' in this context means that there is less additive in the chamber after the respective stroke than before the respective stroke.

Analogously, when the above texts states that a chamber is filled with additive, this does not require that the chamber is completely filled with additive. The word 'filled' in this context means that there is more additive in the chamber after the respective stroke than before the respective stroke.

The additive that is injected into the pipe portion may be a fluid.

In an embodiment, at least the electromagnetic linear motor and the pump portion are arranged at an outer side of, i.e. outside of, the pipe portion. In other embodiments, also the additive outlet chamber and/or the connector may be arranged outside of the pipe portion. In embodiments, the additive outlet chamber being inside or outside of the pipe portion is depending on the stroke the piston is performing. Advantageously, when some or all of the components of the injection assembly are arranged outside of the pipe portion, the flow in the pipe portion is less disturbed or non-disturbed, allowing the amount of additive injected into the pipe portion and the mixing of the additive and the fluid to be accurately controlled.

In embodiments, a first non-return valve is arranged between the additive inlet chamber and the additive outlet chamber. In further embodiments, a second non-return valve is arranged between the additive inlet chamber and the reservoir. The non-return valves may be adapted to close during a compression stroke of the piston and to open during a decompression stroke of the piston, or vice versa. The non-return valves may be a dynamic seal, or any other non-return seal, e.g. the non-return valve as described in more detail below. A non-return valve may ensure that the additive can only flow in one direction, e.g. no additive can spill back into the additive inlet chamber when the volume of the additive outlet chamber is compressed to inject additive into the pipe portion, when the passage to said additive inlet chamber is closed by the respective non-return valve, preventing the additive to flow through said valve. Hence, when the additive is to be admitted into a chamber, the valve to that chamber may be opened. For example, when the additive is to be admitted into the additive inlet chamber from the reservoir, the valve between the reservoir and the additive inlet chamber may be opened, and the valve between the additive inlet chamber and the additive outlet chamber may advantageously be closed. When the additive is to be admitted from the additive inlet chamber into the additive outlet chamber, the valve between the additive inlet chamber and the additive outlet chamber may be opened, while the valve between the reservoir and the additive inlet chamber may preferably be closed. Closing a valve advantageously ensures a better compression of the chamber, controlling the flow path and amount of the additive more precisely.

In an embodiment, the additive outlet chamber, that may be defined by a fluid-tight additive outlet chamber cover, is stationary arranged with respect to the pipe portion, adjacent to and at an outer side of the pipe portion, which additive outlet chamber is in fluid communication with said pipe portion via a passage opening in a wall of the pipe portion, while the armature of the linear motor is at least partially arranged inside said additive outlet chamber, possibly covered by a fluid-tight armature cover, while the stator of the linear motor is preferably arranged outside of the additive outlet chamber, the armature being configured to reciprocate inside said additive outlet chamber, thereby, in use, alternatingly compressing and decompressing a volume of said additive outlet chamber with a compression and decompression stroke, such that a compression stroke of said armature causes the additive to be directly injected from the additive outlet chamber into the pipe portion, in particular through the passage opening. Effectively, in such an embodiment, at least an end portion of the armature facing the passage opening may function as a piston head that compresses and decompresses a volume of the additive outlet chamber.

Advantageously, all moving parts of the injection assembly may be arranged inside the stream path of the additive, the moving parts being driven, directly or indirectly, by an electromagnetic field induced by the stator that is arranged away from and outside of the fluid stream and arranged at a distance from the armature, wherein no physical connection is present between the stator and the armature.

This is different than, and advantageous with respect to many known pumps, such as a membrane pump, a plunger pump, or an ordinary piston pump, where at least one component of the pump is in contact with both an outside environment and the additive that is to be injected.

By providing all movable parts of the injection assembly inside the stream path of the additive, and in contrast to known pumps, a possible leakage or a possible damage to a moving component of the injection assembly, will not result in additive leaking out of the stream path of the additive, and will hence not damage the drive and/or an environment of the injection assembly. Further, any seal where a moving part of a pump enters the stream path of the additive may be eliminated, thereby reducing the number of components in the injection assembly. More specifically, critical components of a pump that require relatively a lot of inspection and replacement, and thus downtime, may be eliminated from the pump.

Further advantageously, the flow path of additive in the injection pump is unobstructed when all moving parts are designed to be arranged inside the stream path of the additive.

In embodiments, the additive is forced into and out of the additive inlet chamber by a decompression stroke or a consecutive compression stroke of the piston, respectively, said compression stroke forcing the additive from the additive inlet chamber, through the non-return valve, into the additive outlet chamber. A compression stroke of the armature, which may correspond to a decompression stroke of the piston, then forces the additive from the additive outlet chamber, through the passage opening, directly into the pipe portion.

In embodiments, an armature cover fully surrounds the armature. In other embodiments, the armature cover is comprised of e.g. an armature cover body and an armature cover cap connected to each other in a fluid-tight manner and moving along with each other.

In an embodiment, the linear motor is arranged between the pump portion and the pipe portion, the injection pump being arranged completely outside of the pipe portion. The injection pump is then arranged at one side of the pipe portion, on an outer side thereof. Preferably, the injection pump is arranged below the pipe portion, to prevent air to be trapped inside the pump.

In an embodiment, the piston and the armature are directly coupled by a coupling member, such that when the additive outlet chamber is compressed, the additive inlet chamber is decompressed, and vice versa.

In an embodiment, the additive outlet chamber is defined by a fluid-tight additive outlet chamber cover, and a bypass channel is defined between the armature cover and the chamber cover or through the armature. Hence, the armature fits inside the additive outlet chamber cover and is able to reciprocate inside the additive outlet chamber cover, while bypass channels are arranged in between said covers or a bypass channel is arranged in a part of the armature.

In an embodiment, at least the reciprocating speed of the armature, the minimum volume of the additive outlet chamber, the size of the bypass channel, and the viscosity of the additive are matched to each other, to damp a compressive stroke of the armature near or at its dead centre near the pipe portion. Preferably, the stroke of the armature ends before the wall of the pipe portion, to prevent damaging said wall. Depending on the above-mentioned parameters, the pressure in the additive outlet chamber may rise faster or slower and/or friction form fluid moving through the bypass channels may rise faster or slower when the volume of the additive outlet chamber is compressed and additive is injected through the passage opening into the pipe portion. Preferably, a sufficient amount of additive is left in the additive outlet chamber to damp the motion of the armature as said armature approaches the wall of the pipe portion.

In an embodiment, the linear motor is arranged at a first outer side of the pipe portion, preferably below the pipe portion, the additive inlet chamber is arranged at a diametrically opposite second outer side of the pipe portion, preferably above the pipe portion, wherein the linear motor and the armature are direction coupled with a coupling member, and the pipe portion comprises two openings or cut-outs through which said coupling member extends at least partially in an internal volume of the pipe portion. The connector may extend substantially through a middle of the pipe, or may extend through a sideways extension of the pipe. The linear motor and the piston being arranged at opposite outer sides of the pipe portion and being connected with a coupling member that extends through the pipe portion, allows for an easy direct injection of the additive in the pipe portion. Preferably, the piston and additive inlet chamber are arranged above the pipe portion such that, when there are leakages in the supply of the additive, the additive leaks into the fluid. For example, a concentration indicator may be arranged downstream of the injection assembly, to measure the concentration of the additive in the fluid and to check it against a preferred or set concentration. When said concentration is too high as a result of additive leaking into the fluid, a leakage can be detected relatively early, preferably before the leaked additive has damaged the existing pipe or components of the injection assembly.

Further advantageously, with the pump portion arranged above the pipe section and the linear motor arranged below the pipe section, the linear motor may not become contaminated with additive when there are leaks in the pump portion.

Further advantageously, when the linear motor is arranged below the pipe portion, no air may be trapped inside a cylinder surrounding the armature of the linear motor.

In an embodiment, the piston is arranged in the additive inlet chamber and the additive outlet chamber is separated from the additive inlet chamber by the piston, the additive outlet chamber being configured to move along with the piston, such that, in use, upon said second decompression stroke, the additive outlet chamber moves into the pipe portion, releasing said additive directly in said pipe portion. Hence, in embodiments, the position of the additive outlet chamber is non-stationary, and depends on the stroke position of the piston. In some positions, the additive outlet chamber may be fully or partially inside the pipe portion or a stream area of the pipe portion, and in other positions, the additive outlet chamber may be fully outside the pipe portion or the stream area of the pipe portion, or may be arranged inside an opening or cut-out of the pipe portion, outside of the flow volume of the pipe portion.

In an embodiment, the armature comprises bypass channels and is configured to reciprocate in a cylinder, thereby, in use, alternatingly compressing and decompressing a volume of said cylinder with a compression stroke and a decompression stroke, wherein the bypass channels are sized to damp the compression stroke of the armature by a compression of a fluid, such as air, gas, or liquid, in said cylinder before or when a dead centre of said compression stroke is reached.

In an embodiment, the injection assembly further comprises a flow sensor, in particular provided on the pipe portion, and a controller, wherein the flow sensor is configured to measure the mass flow of the fluid inside the pipe portion and/or the pipe section, and wherein the controller is configured to control the reciprocating frequency and/or the stroke length of the linear motor based on at least a measurement of the flow sensor. Preferably, the flow sensor may be aligned with a wall of the pipe portion and/or pipe section, to ensure an undisturbed flow of the fluid inside the pipe portion and/or pipe section. Preferably, the flow sensor may be arranged upstream of the opening passage and/or the opening or cut-out in the wall of the pipe portion. Alternatively and/or additionally, a flow sensor may be arranged downstream of the opening passage and/or the opening or cut-out in the wall of the pipe portion.

In embodiments, the injection assembly may further comprise a temperature sensor that is configured to measure the temperature of the fluid inside the pipe portion and/or the pipe section, and wherein the controller is configured to control the reciprocating frequency and/or the stroke length of the armature based on at least a measurement of the temperature sensor.

In an embodiment, the existing pipe and the pipe portion have a substantially equal inner diameter, to ensure a virtually undisturbed flow of the fluid inside the pipe section into and out of the pipe portion.

In an embodiment, at least one of the non-return valves comprises a resilient member, a ball, a seat, and a flow channel through the seat and around the ball, wherein, in a closed state of the valve, the seat receives the ball, such that the ball and the seat close the flow channel while the ball is pressed onto the seat by the resilient member and wherein, in an open state of the valve, the ball is moved away from the seat, such that a flow channel emerges between the seat and the ball. However, other embodiments of non-return valves are known and may be used in the injection assembly.

Preferably, the seat is made of a resilient material, allowing some margin for the ball to fall into the seat and close the flow channel. This way, trace amounts of dirt settling on the seal and/or the ball will not disturb the operation of the non-return valve.

When the pump is new and/or after the pump is cleaned, the flow channel of the additive through the pump is typically filled with air, i.e. vacant of additive. Before working optimally, the entire pump is preferably filled with additive. Typically, there is more additive in the pump than the pre-determined amount that is injected into the pipe portion with each stroke cycle of a decompression stroke and a compression stroke. This process of filling the pump with additive when the pump is new or after the pump is cleaned, is called priming. Especially during priming, a good closure of the valve is advantageously, to ensure sufficient pressure to be built up in the chambers when they are compressed.

A non-return valve comprising a resilient member and a ball is further advantageous when the pump is installed upside-down or on the side, i.e. when the force of gravity is not working in the same direction as the desired movement direction of the ball between an open position of the valve and a closed position of the valve. The resilient member will then ensure a correct movement of the ball to close and open the valve.

Depending on the additive to be injected into the fluid in the pipe portion, different materials may be selected for the components of the valve. In an embodiment, the seat and/or the resilient member are made from a synthetic rubber, such as a fluorocarbon elastomer, preferably FKM.

In an embodiment, the non-return valve comprises a mechanical stopping member that restricts the movement of the resilient member in a direction away from the seat. This may limit the wear of the resilient member, increasing the lifespan of said resilient member.

In an embodiment, at least one of the non-return valves is embodied as a dynamic seal that is adapted to open when a pressure on a first side of the seal is larger than a pressure on a second side of the seal, and that is adapted to close when the pressure on the first side of the seal is smaller or equal to the pressure on the first side of the seal. For example, the dynamic seal may be arranged between the additive inlet chamber and the additive outlet chamber, and open when the pressure in the additive inlet chamber is larger than the pressure in the additive outlet chamber.

In a second aspect, the invention relates to an injection pump comprising:

an electromagnetic linear motor comprising a stator and a movable armature that is configured to be driven reciprocatingly with respect to the stator, a pump portion comprising a piston and an additive inlet chamber, wherein the piston is coupled to the armature, and is configured to reciprocate in said additive inlet chamber, thereby, in use, alternatingly compressing and decompressing a volume of said additive inlet chamber with a compression stroke and decompression stroke, and an additive outlet chamber arranged or arrangable in direct fluid communication with the pipe portion and arranged in fluid communication with the additive inlet chamber;

wherein, in use, a first decompression stroke of said piston discharges a predetermined amount of said additive from said reservoir into said additive inlet chamber, a consecutive compression stroke of said piston causes said additive to flow from the additive inlet chamber into the additive outlet chamber, and a consecutive second decompression stroke of said piston causes the additive to be directly injected into the pipe portion from the additive outlet chamber.

Although certain embodiments of the injection pump have been described in the above in relation to an injection assembly comprising an injection pump, the same embodiments may be conceived for an injection pump according to the second aspect of the invention.

In a third aspect, the invention relates to a method for the supply of a predetermined amount of an additive from a reservoir to a fluid in a pipe, e.g. a pipe portion of an injection assembly or a pipe section of an existing pipe, using an injection assembly and/or an injection pump according to the first and second aspect of the invention, respectively.

Hence, the invention relates to an in an existing fluid pipe maze insertable configuration of components for the dosed addition of additives to a fluid pipe maze.

Dosed addition of substances to a fluid piping maze, such as chlorine dioxide to tap water, is usually achieved by retaining a quantity of a mixture having a predetermined volume percentage of dissolved solid substance and a liquid in a buffer, and supplying therewith a dosing pump connected to a fluid pipe maze.

To provide a precise dosage to the fluid that flows through said pipe maze, measurements have to be taken, such as the flow speed and the temperature of the flowing fluid. Therefore e.g. sensors, are mounted into or onto the fluid pipe. The problem is that the space around these pipes is often limited and a post-mounting of all these components in such an existing fluid pipe maze turns out to be difficult or even impossible. Even more so when aggressive substances are to be supplied, as one should then leave additional space for maintenance and inspection on all these parts. That means, that in many cases the pipe must be diverted, and the components required for the dosing must be mounted into or on said diverted pipe. Therewith, the dosing is less direct and hence less effective and the flow and order is disturbed and the size of the pipe maze is enlarged.

The aim is to increase the chance that insertion of required components for the dosing of substances, in particular corrosion-dangerous or aggressive substances, in a fluid pipe maze is possible and to increase the durability by decreasing the corrosion, and ease maintenance and improve the inspection of said components compared to the state of the art.

Known is a water-driven pumping configuration, that is directly connected to a diversion pipe that is branched from the main pipe, so that the water is guided before the drive, comprising a reciprocating driver that is driven by the water-stream, that drives a dosage pump that is arranged in line, wherein the sucked additive is mixed with the water-stream. This dosage device occupies much space compared to the main pipe and cannot be connected to the main pipe directly as this would hinder the flow too much. Moreover, the amount of consumed additive depends on the flow speed and cannot be controlled electronically.

From the art of internal combustion engines, dosage devices are known, that are directly mounted onto the pipes. These supply additives computer-controlled by means of an electromagnetically driven reciprocating pump device that is mounted onto the pipe, wherein the drive and the pumping portion are placed in line and the fluid is transported through the dosage device axially. (DE 102008055611 A1) All these cases not only relate to an architecture that is designed integrally with the pipe maze, in contrast to the problem statement which relates to a part that is insertable in an existing random surrounding, but these cases neither relate to a corrosion-dangerous substance and the pumping device is also not suited for the displacement of aggressive substances as these are also transported through the drive portion that is sensitive to corrosion.

The formulated aim is achieved by uniting all or at least a number of the components to be arranged onto, to, or into a fluid pipe, such as a dosage pump, temperature and flow speed indicators, for the controlled accurate dosing of an additive to a fluid maze in one coupling piece, and providing this coupling piece with a known fluid-tight connection, allowing the two ends of an interrupted horizontally arranged fluid pipe to be connected without narrowing the flow channel and joining an adapted electromagnetic linearly driven reciprocating dosing pump to said coupling piece, such that it extends with the linear drive axis through the horizontally arranged flow channel, or through a local widening of said flow channel that is arranged next to said flow channel, wherein the electromagnetic drive portion, comprising a cylinder and a magnetic drive placed therein and a spool arranged around said cylinder, extends below the pipe and the pump portion that is driven thereby extends above the pipe and the exhaust of the piston mounds directly into the fluid that flows through the flow channel. By this arrangement, the length of the assembly is more evenly spread over the space that is arranged on both sides of the pipe and the additive will always be carried directly along with the fluid streaming through the fluid pipe, also in case the pump would leak the electromagnetic drive portion of the dosage device will be spared of additive and no air will be able to accumulate below the magnetic driver in the cylinder surrounded by a coil, which would otherwise disturb the operation, wherein the invention provides in such a limited open connection between the space in the cylinder above and below the magnetic driver, for example by determination of the space between the magnetic driver and the cylinder wall, that in relation to the chosen force of the electromagnetic driver, a sufficient amount of fluid can pass it to prevent the build-up of pressure and the forming of a vacuum in the cylinder, which would prevent a proper functioning and that nevertheless sufficient resistance is provided to somewhat damp the non-driven deflecting movements of the magnetic driver each time before the dead centre with the aim to reduce wear.

The invention further proposes to dimension the electromagnetically propelled magnetic driver and the cylinder of the pump, which are connected in line with each other, in such a way and to connect the piston of the pump easily releasable with the magnetic driver by means of for example a snap connector, such that all said parts can be pulled out of the housing with one movement through one fluid-tightly closable opening at the end of the pump and can easily be disassembled outside said housing and re-assembled and placed back, whereby wear-sensitive parts such as piston seals can be inspected for wear simply and can be replaced quickly.

The invention further proposes to provide the coupling piece with a recording device for flow speed and temperature sensors, such as a case in which such a sensor can be mounted fluid-tightly by means of seals. In particular a mounting device of a fluid flow indicator as disclosed in patent application NL 1041675 right before the connection with the fluid pipe.

The advantages of the invention are broadening of the placement possibilities, fast mounting, easy inspection and maintenance and replacement of wear-sensitive parts, direct discharge of the additive in the main stream, whereby accumulation is prevented and even excessively expelled additive by improper functioning of the pump is directly drained, whereby the electromagnetic drive is spared of additive, controllable dosage by setting the electromagnetic field based on measurements of speed and temperature of the fluid flow performed close to the dosage pump by a flow speed indicator and a temperature indicator as described in patent application NL1041675 mounted into or against the fluid flow by the coupling piece.

These and other aspects of the invention will be more readily appreciated as the same becomes better understood by reference to the following detailed description and considered in connection with the accompanying drawings in which like reference symbols designate like parts.

Figure 2:
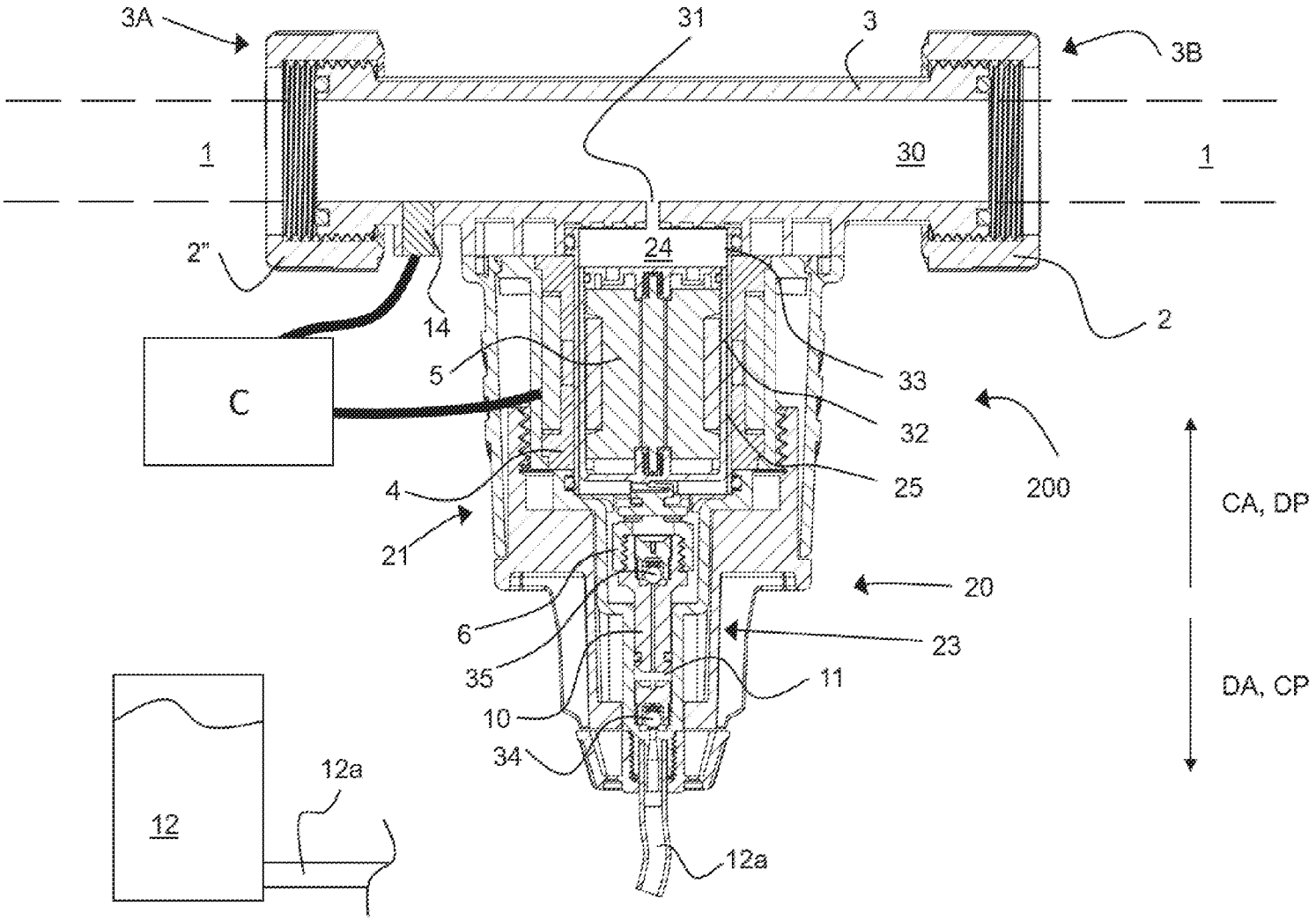
Figure 3:
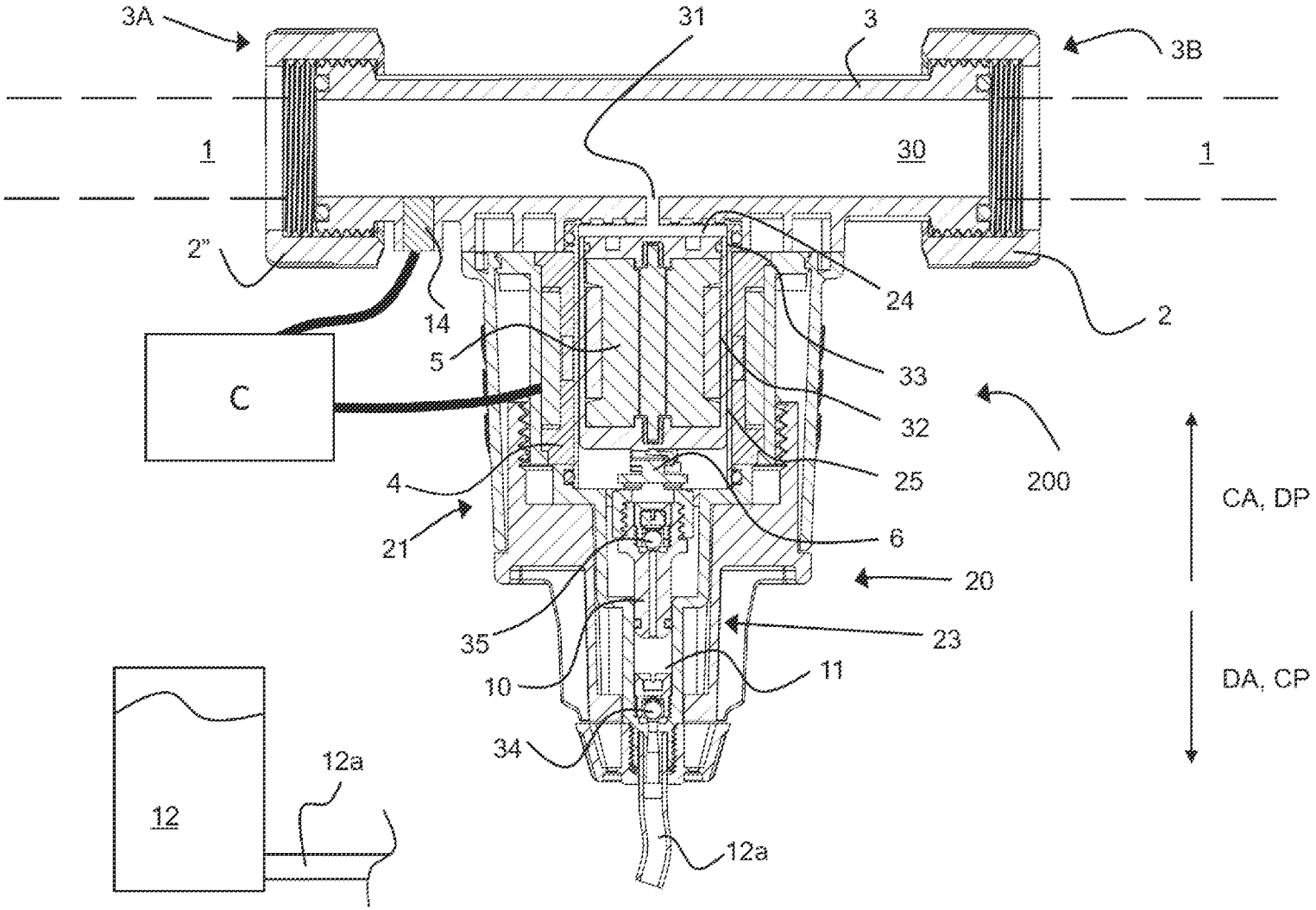

FIG. 1 schematically shows a cross-section along a longitudinal axis of a first embodiment of an injection assembly/injection pump according to the invention;

FIG. 2 schematically shows a cross-section along a longitudinal axis of a second embodiment of an injection assembly/injection pump according to the invention, wherein the injection pump is in a downwards position relative to the pipe portion;

FIG. 3 schematically shows a cross-section along a longitudinal axis of the injection assembly/injection pump of FIG. 2, wherein the injection pump is in an upwards position relative to the pipe portion;

FIG. 4A schematically shows an isometric cut-away view of components of a non-return valve according to embodiments of the invention;

FIG. 4B schematically shows cross-sectional view of a non-return valve according to embodiments of the invention, in a closed state thereof;

FIG. 4C schematically shows a cross-sectional view of the non-return valve of FIG. 4B, in an open state thereof.

With reference to FIG. 1, a first embodiment of an injection assembly 100 is shown, the injection assembly 100 being configured to supply a predetermined amount of an additive from a reservoir 12 to a fluid in an existing pipe. The injection assembly 100 comprises a pipe portion 3, two fluid-tight couplings 2, 2" and an injection pump 20, where it is noted that the invention also relates to the injection pump 20.

The pipe portion 3 comprises a first end 3A and an opposite second end 3B, which pipe portion 3 is configured to be coupled with the existing pipe 1 after a pipe section of said existing pipe 1 having a length similar to the length of the pipe portion 3 has been removed from said existing pipe 1, such that said pipe portion 3 effectively replaces said pipe section 1.

The two fluid-tight couplings 2, 2" respectively couple the first end 3A and the second end 3B of the pipe portion 3 to the existing pipe 1 in a fluid-tight manner.

The injection pump 20 comprises an electromagnetic linear motor 21, a pump portion 23 comprising a piston 10 and an additive inlet chamber 11, here called pump chamber 11, a coupling member 6, and an additive outlet chamber 24.

The electromagnetic linear motor 21 comprises a stator 4, and a movable armature 5 that is configured to reciprocate with respect to the stator 4. As visible in FIG. 1, the linear motor 21 is arranged at a first outer side 3C of the pipe portion 3, below the pipe portion 3. The pipe portion 3 comprises a first cut-out 9, in which first cut-out 9 the linear motor 21 is arranged and able to reciprocate. More specifically, the first cut-out 9 defines a cylinder (cylindrical space) 8.

The additive outlet chamber 24 is arrangable in direct fluid communication with the pipe portion 3 by lowering said additive outlet chamber 24, as will be explained in more detail below. The additive outlet chamber 24 is further arranged in fluid communication with the pump chamber 11.

In FIG. 1, the armature 5 is shown approximately halfway inside the cylinder 8, in a relatively neutral position. With respect to said neutral position, the armature 5 is able to reciprocate in the cylinder 8 thereby, in use, alternatingly compressing and decompressing a volume of said cylinder 8 with a compression stroke CA and a decompression stroke DA.

The compression stroke CA of the armature 5 is damped by a compression of a fluid, such as a gas or a liquid, in said cylinder 8 before or when a dead centre of said compression stroke CA is reached.

The armature 5 comprises bypass channels 25 and is configured to reciprocate in a cylinder 8, thereby, in use, alternatingly compressing and decompressing a volume of said cylinder 8 with a compression stroke CA and a decompression stroke DA, wherein the bypass channels 25 are sized to damp the compression stroke CA of the armature 5 by a compression of fluid in said cylinder 8 before or when a dead centre of said compression stroke CA is reached.

The piston 10 of the pump portion 23 is configured to reciprocate in the pump chamber 11 of the pump portion, thereby, in use, alternatingly compressing and decompressing a volume of said pump chamber 11 with a compression stroke CP and decompression stroke DP.

As visible, the pump chamber 11 is arranged at a second outer side 3D of the pipe portion 3, above the pipe portion 3, the second outer side 3D being diametrically opposite of the first outer side 3C. The pump chamber 11 is separated from the reservoir 12 with a non-return valve 34. The pipe portion 3 comprises a second cut-out 27, in which second cut-out 27 the piston 10 is arranged and able to reciprocate. More specifically, the pump chamber 11 is associated with the second cut-out 27.

As visible, the piston 10 is arranged in the pump chamber 11. The additive outlet chamber 24 is separated from the pump chamber 11 by the piston 10, the additive outlet chamber 24 being configured to move along with the piston 10, such that, in use, upon a decompression stroke DP of the piston 10 in the pump chamber 11, i.e. upon the piston 10 moving down and towards an internal volume 20 of the pipe section 3, the additive outlet chamber 24 moves into the pipe portion 3, releasing said additive directly in said pipe portion 3.

A non-return valve 35 may be arranged between the pump chamber 11 and the additive outlet chamber 24 and may here be embodied as a dynamic seal that is adapted to open when a pressure on a first side of the seal is larger than a pressure on a second side of the seal, and that is adapted to close when the pressure on the first side of the seal is smaller or equal to the pressure on the first side of the seal. Hence, the non-return valve 35 is adapted to close during a compression stroke of the piston 10 and to open during a decompression stroke of the piston 10.

As visible, the coupling member 6 connects the armature 5 of the linear motor 21 to the piston 10, coupling the motion of the piston 10 and the armature 5 to each other. The coupling member 6 extends through the first cut-outs 9 and the second cut-out 27, and is arranged partially in an internal volume 30 of the pipe portion 3. As visible, the coupling member 6 may be disconnected, thereby separating the pump portion 23 from the linear motor 21.

FIG. 1 hence shows an injection assembly 100 wherein, in use, a first decompression stroke DP of said piston 10 discharges a predetermined amount of said additive from said reservoir 12 into said pump chamber 11, a consecutive compression stroke CP of said piston 10 causes said additive to flow from the pump chamber 11, into the additive outlet chamber 24, and a consecutive second decompression stroke DP of said piston 10 causes the additive to be directly injected into the pipe portion 3 from the additive outlet chamber 24.

As visible, the electromagnetic linear motor 21 and the pump portion 23 are arranged at an outer side of the pipe portion 3.

In other words, FIG. 1 discloses a through-going fluid pipe 1, that are connected with a coupling piece 3 via fluid-tight couplings 2 and 2" below which the electromagnetic drive is placed, comprising a spool 4 inducing an alternating magnetic force moving back and forward a driver 5 is placed, which is connected to a piston 10 of reciprocating pump device that is mounted at a top of a coupling piece 3 by means of a releasable snap connection 6, which pump device is connected to a reservoir 12 from which the additive is sucked via a tube 12*a*. In this embodiment, the connector between the magnetic drive 5 and the piston 10 extends through the flow channel, but could also extend through a local widening of the flow channel, whereby the piston and driver that are connected in line with each other would move outside of the stream area, but still in an open direct communication remains between the fluid steam and the exhaust of the piston. The inner side of the cylinder that is surrounded by the spool and the outer side of the magnetic drive 5 are provided with a protecting plastic layer and between that cylinder and the magnetic drive sufficient space is left by determination of the fit in relation to the force of the magnetic drive to sufficiently compensate pressure and vacuum forming in the area 8 in the cylinder below the magnetic drive 5 during the upwards and downwards movement of the magnetic drive 5 for the intended operation and yet leave sufficient resistance to somewhat damp the non-driven deflecting movements of the magnetic driver each time before the dead centre, thereby resisting wear. The piston 10 arranged above the pipe is connected to a reservoir 12 and exhausts the additive into the through-going fluid pipe 10 with a push stroke. Directly before the coupling that connects the two ends of the fluid pipe 1 a mounting device is provided for one or more sensors 14 that communicate with a computer for the measurement of for example the flow speed or temperature or both in the through-going pipe 1, for passage to a calculation program that controls the reciprocating motion of the magnetic driver.

With reference to FIGS. 2 and 3, a second embodiment of an injection assembly 200 is shown, the injection assembly 200 being configured to supply a predetermined amount of an additive from a reservoir 12 to a fluid in an existing pipe. The injection assembly 200 comprises a pipe portion 3, two fluid-tight couplings 2, 2" and an injection pump 20, where it is noted that the invention also relates to the injection pump. FIG. 2 shows the injection assembly with a pump portion 23 of the injection pump 20 and the armature 5 in a relatively low position, i.e. in a compressed state of the pump portion 23, while FIG. 3 shows the injection assembly with the pump portion 23 of the injection pump 20 and the armature 5 in a relatively high position, i.e. in a decompressed state of the pump portion.

The pipe portion 3 comprises a first end 3A and an opposite second end 3B, which pipe portion 3 is configured to be coupled in line with a pipe, for example with an existing pipe 1 after a pipe section of said existing pipe 1 having a length similar to the length of the pipe portion 3 has been removed from said existing pipe 1, such that said pipe portion 3 effectively replaces said pipe section 1.

The two fluid-tight couplings 2, 2" respectively couple the first end 3A and the second end 3B of the pipe portion 3 to the existing pipe 1 in a fluid-tight manner.

The injection pump 20 comprises an electromagnetically driven linear motor 21, a pump portion 23 comprising a piston 10 and an additive inlet chamber 11, here also called pump chamber, a coupling member 6, an additive outlet chamber 24, and a non-return valve 35. The first non-return valve 35 is arranged between the pump chamber 11 and the additive outlet chamber 24, adapted to close during a compression stroke of the piston 10 and to open during a decompression stroke of the piston 10.

The electromagnetic linear motor 21 of the injection pump 20 comprises a stator 4, and a movable armature 5 that is configured to reciprocate with respect to the stator 4. As visible, the linear motor 21 is arranged between the pump portion 23 of the injection assembly 200 and the pipe portion 3 of the injection assembly 200, the injection pump 20 being arranged completely outside of the pipe portion 3.

The piston 10 of the pump portion 23 is configured to reciprocate in the pump chamber 11, thereby, in use, alternatingly compressing and decompressing a volume of said pump chamber 11 with a compression stroke CP and decompression stroke DP.

The coupling member 6 of the injection pump 20 connects the armature 5 of the linear motor 21 to the piston 10, coupling the motion of the piston 10 and the armature 5 to each other. Here, the piston 10 and the movable armature 5 are directly coupled, such that when the additive outlet chamber 24 is compressed, the pump chamber 11 is decompressed, and vice versa.

The additive outlet chamber 24 of the injection pump is arranged in direct fluid communication with the pipe portion 3. The additive outlet chamber 24 is stationary arranged adjacent and at an outer side of the pipe portion 3, which additive outlet chamber 24 is in direct fluid communication with said pipe portion 3 via a passage opening 31 in a wall of the pipe portion 3.

As visible, the armature 5 of the linear motor 21 is arranged inside said additive outlet chamber 24 and may be covered by a fluid-tight armature cover 32, wherein the armature 5 is configured to reciprocate inside said additive outlet chamber 24. Upon this reciprocating motion, the armature 5 alternatingly compresses and decompresses a volume of said additive outlet chamber 24 with a compression stroke CA and a decompression stroke DA, such that a compression stroke CA of said armature 5 causes the additive to be directly injected from the additive outlet chamber 24 into the pipe portion 3.

As is visible, the additive outlet chamber 24 is defined by a fluid-tight additive outlet chamber cover 33, and a bypass channel 25 is defined between the armature cover 32 and the chamber cover 33.

The injection assembly 200 further comprises a second non-return valve 34, arranged between the reservoir 12 and the pump chamber 11.

In use, a first decompression stroke DP of said piston 10 while the first non-return valve 35 is closed and the second non-return valve 34 is opened discharges a predetermined amount of said additive from said reservoir 12 into said pump chamber 11, a consecutive compression stroke CP of said piston 10 while the first non-return valve 35 is opened and the second non-return valve 34 is closed causes said additive to flow from the pump chamber 11, through the first non-return valve 35, into the additive outlet chamber 24, and a consecutive second decompression stroke DP of said piston 10 while the first non-return valve 35 is opened again and the second non-return valve 34 is closed again causes the additive to be directly injected into the pipe portion 3 from the additive outlet chamber 24.

More specifically, the operation of the injection assembly 200 may be described with reference to FIGS. 2 and 3, wherein the operation is described starting from a position as shown in FIG. 2. It is however noted that the injection assembly 200 performs a continuous cycle of reciprocating movements or strokes, when operated normally, and that the description of the operation, alternatively, may just as well be started from FIG. 3.

FIG. 2 shows the injection assembly 200 with the piston 10 in the pump chamber 11 in a relatively low position, i.e. a volume of the pump chamber 11 being compressed. The situation depicted in FIG. 2 may show the dead centre of the compression stroke CP of the piston 10. The additive outlet chamber 24, on the other hand, is relatively decompressed; the armature 5 having a relatively low position in the additive outlet chamber 24.

The movements of the armature 5, the coupling member 6, and the piston 10 are all directly coupled and synchronous, such that, when the armature 5 is moved upwards, i.e. towards the wall of the pipe portion 3, the connector 6 and the piston 10 move along with it. Upon moving upwards, the pump chamber 11 is decompressed, and the additive outlet chamber 24 is compressed.

In a normal operative condition, in the situation depicted in FIG. 2, the additive outlet chamber 24 is filled with additive, and the pump chamber 11 is vacant of additive.

When the armature 5 is now moved upwards, the first non-return valve 35 is preferably closed, reducing the volume in the additive outlet chamber 24, and forcing the additive from the additive outlet chamber 24, through the outlet opening 31, into an internal volume 30 of the pipe portion 3.

Simultaneously, the volume of the pump chamber 11 is increased as the piston 10 is moved upwards. When the second non-return valve 34 is now opened, additive is introduced from the reservoir 12 into the pump chamber 11.

Hence, at the end of the upwards movement of the armature 5, which defines both a compression stroke of the armature 5 as well as a decompression stroke CP for the piston 10, a volume of the additive outlet chamber 24 is compressed, vacant of additive, and a volume of the pump chamber 11 is decompressed, filled with additive.

This situation is shown in FIG. 3.

Continuing the stroke cycle, now with reference to FIG. 3, the armature 5 is moved downwards again, i.e. away from the wall of the pipe portion 3. This compresses the pump chamber 11, as the piston 10 is moved into it, reducing the internal volume of the pump chamber 11, and increasing the internal volume of the additive outlet chamber 24 as the armature 5 moves out of it. When now second first non-return valve 34 is closed and the first non-return valve 35 is opened, the increasing pressure inside the pump chamber 11 forces the additive to move out of said pump chamber 11, through the first non-return valve 35, and into the additive outlet chamber 24, which is enlarged as the armature 5 is moving downwards.

When this downwards movement of the armature 5 is completed, the situation shown is FIG. 2 is achieved again, and the stroke cycle is completed.

During the upwards motion of the armature 5, it moves towards the wall of the pipe portion 3. To prevent wear of and/or damage to said wall, preferably at least the reciprocating speed of the armature 5, the minimum volume of the additive outlet chamber 24, the size of the bypass channel 25, and the viscosity of the additive are matched to each other, to damp a compressive stroke CA of the armature 5 near or at its dead centre near the pipe portion 3.

With reference to FIGS. 1-3, it may be observed that the injection assembly further comprises a flow sensor 14 and a controller C, wherein the flow sensor 14 is configured to measure the mass flow of the fluid inside the pipe portion 3, and wherein the controller C is configured to control the reciprocating frequency and/or the stroke length of the armature 5 based on at least a measurement of the flow sensor 14.

It may further be noted with reference to FIGS. 1-3 that the existing pipe 1 and the pipe portion 3 preferably have a substantially equal diameter. This is preferred to minimize the disturbance of the flow volume inside the pipe by the mounting of the injection assembly.

With reference to FIGS. 4A-4C, an embodiment of the non-return valve 34 is shown, wherein FIG. 4A shows an isometric cut-away view of the valve 34, wherein FIG. 4B shows an closed state of the valve 34, where additive is unable to flow or move through the valve 34, and wherein FIG. 4C shows an open state of the valve 34, where additive is able to flow or move through the valve 34.

As can be observed, the non-return valve 34 comprises a resilient member 341, a ball 342, a seat 343, and a flow channel 344 through the seat 343 and around the ball 342, wherein, in a closed state of the valve 34, the seat 343 receives the ball 342, such that the ball 342 and the seat 343 close the flow channel 344 while the ball 342 is pressed onto the seat 343 by the resilient member 341 and wherein, in an open state of the valve 34, the ball 342 is moved away from the seat 343, such that a flow channel 344 emerges between the seat 343 and the ball 342. The resilient member 341 provides a constant downwards force onto the ball 342 when the valve is in a closed state, ensuring a proper closure of the valve 34. Hence, when the valve 34 is in a closed state, the resilient member 341 is tensioned.

Advantageously, the non-return valve 34 further comprises a mechanical stopping member 345 that restricts the movement of the resilient member 341 in a direction away from the seat 343. The seat 343 and/or the resilient member 341 may be made from a synthetic rubber, such as a fluorocarbon elastomer, although the material choice will typically depend on the additive to be injected into the pipe 1 or pipe section 3.

The invention further relates to a method for the supply of a predetermined amount of an additive from a reservoir 12 to a fluid in a pipe 1, 3 using an injection assembly 100 according to the invention and/or an injection pump 20 according to the invention.

As explained above, an injection assembly configured to supply an additive from a reservoir to a fluid in a pipe comprises: a pipe portion, couplings to couple ends of the pipe portion to the pipe; and an injection pump comprising:

- a linear motor comprising a stator, and an armature that is electromagnetically reciprocatingly driven by the stator,
- a pump portion comprising a piston and an additive inlet chamber, wherein the piston is coupled to the armature, and is configured to reciprocate in said inlet chamber, thereby alternatingly compressing and decompressing a volume of said inlet chamber, and
- an additive outlet chamber in fluid communication with the pipe portion; wherein, in use, a first decompression stroke of said piston discharges additive from said reservoir into said inlet chamber, a consecutive compression stroke causes said additive to flow from the inlet chamber, into the outlet chamber, and a second decompression stroke directly injects the additive into the pipe portion from the outlet chamber.

The invention may also be explained as described below in the following clauses:

1. In an existing fluid pipe maze insertable configuration of components for the dosed addition of additives to that fluid pipe maze, characterised in that, the components needed for the dosed addition are united into one coupling piece, that is provided with a known fluid-tight coupling, that allows to connect the two ends of a, for insertion of that coupling piece, interrupted horizontally arranged fluid pipe without narrowing the flow channel.
2. In an existing fluid pipe maze insertable configuration of components for the dosed addition of additives to that fluid pipe maze according to clause 1, characterised in that, one of the components is an electromagnetic linear driven dosage pump, that is connected to the coupling piece in such a way, that the linear connection between magnetic driver and piston of the pump extend through the flow channel or through a sideways widening of said flow channel and that the electromagnetic drive part is preferably placed under the pipe and the pump portion is placed above the pipe such that the exhaust of the piston directly mounds into the flow channel.

3. In an existing fluid pipe maze insertable configuration of components for the dosed addition of additives to that fluid pipe maze according to clause 1 and 2, characterised in that, an arrangement is formed on the coupling piece 3 directly in front of the coupling 2 with the fluid pipe 1 for the releasable mounting of a temperature indicator and/or a flow speed indicator in or against the fluid stream.
4. In an existing fluid pipe maze insertable electromagnetic linear driven reciprocating fluid pump according to clause 2, characterised in that, by determination of the distance between the magnetic driver and the cylinder wall in association with the to be determined force of the electromagnetic driver, at the bottom of the cylinder a resistance is controlled by pressure and vacuum forming, such that said resistance can be overcome by the magnetic driving force and the non-driven movement of the magnetic driver is damped just before the dead centre.
5. In an existing fluid pipe maze insertable electromagnetic linear driven reciprocating fluid pump for the dosed addition of additives to said fluid pipe maze according to clauses 2, 3, and 4, characterised in that, the magnetic driver and the inner side of the cylinder, wherein the magnetic driver is moved back and forth, are dressed with a synthetic material.
6. In an existing fluid pipe maze insertable electromagnetic linear driven reciprocating fluid pump for the dosed addition of additives to said fluid pipe maze according to clauses 2, 3, 4 and 5, characterised in that, the outer diameter of the cylinder of the pump portion and the and the diameter of the magnetic driver 5 are the same and the magnetic driver 5 and the piston 10 are releasably connected to each other and can unitedly, together with the cylinder of the pump portion, be pulled out of the pump device via a fluid-tight closable opening and can be placed back again.
7. In an existing fluid pipe maze insertable electromagnetically driven dosing pump, characterised in that it is inserted into a fluid pipe 2 and 2" via two couplings and the electromagnetic drive, comprising a spool 4 and a via said spool induced alternating magnetic field up and down moving magnetic driver 5 is placed below the fluid pipe, and a reciprocating pump device 3, coupled between with the piston 10 and magnetic driver to said electromagnetic drive via a decoupleable linear connector 6, is placed above the fluid pipe with the piston 10 and the connecting axis between magnetic driver 5 and the piston 10 extends through the flow channel or also through a local widening of said flow channel and the piston discharges additive that is sucked out of the reservoir with the suction stroke into the through-going flow channel that is coupled via the dosing pump with the push stroke.
8. In an existing fluid pipe maze insertable electromagnetically driven dosing pump according to clause 7, characterised in that it is arranged according to features from clauses 3, 4, 5, and 6.

It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a"/"an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. An injection assembly configured to supply a predetermined amount of an additive from a reservoir to a fluid in a pipe, the injection assembly comprising:

a pipe portion comprising a first end and an opposite second end, which pipe portion is configured to be coupled in line with the pipe;

two fluid-tight couplings, arranged to respectively couple the first end and the second end of the pipe portion to the pipe in a fluid-tight manner; and an injection pump comprising:

an electromagnetic linear motor comprising a stator and a movable armature that is configured to be driven reciprocatingly with respect to the stator, a pump portion comprising a piston and an additive inlet chamber, wherein the piston is coupled to the armature, and is configured to reciprocate in said additive inlet chamber, thereby, in use, alternatingly compressing and decompressing a volume of said additive inlet chamber with a compression stroke and decompression stroke, and an additive outlet chamber in direct fluid communication with the pipe portion and arranged in fluid communication with the additive inlet chamber;

wherein, in use, a first decompression stroke of said piston discharges a predetermined amount of said additive from said reservoir into said additive inlet chamber, a consecutive compression stroke of said piston causes said additive to flow from the additive inlet chamber into the additive outlet chamber, and a consecutive second decompression stroke of said piston causes the additive to be directly injected into the pipe portion from the additive outlet chamber.

2. The injection assembly according to claim 1, wherein at least the electromagnetic linear motor and the pump portion are arranged at an outer side of the pipe portion.

3. The injection assembly according to claim 1, wherein the injection pump further comprises a first non-return valve arranged between the additive inlet chamber and the additive outlet chamber, the first non-return valve being adapted to open during a compression stroke of the piston and to close during a decompression stroke of the piston, such that, in use, a first decompression stroke of said piston, with the first non-return valve closed, discharges a predetermined amount of said additive from said reservoir into said additive inlet chamber, a consecutive compression stroke of said piston, with the first non-return valve opened, causes said additive to flow from the additive inlet chamber, through the first non-return valve, into the additive outlet chamber, and a consecutive second decompression stroke of said piston, with the first non-return valve closed, causes the additive to be directly injected into the pipe portion from the additive outlet chamber.

4. The injection assembly according to claim 1, wherein said additive outlet chamber is fixed adjacent to and at an outer side of the pipe portion, which additive outlet chamber is in fluid communication with said pipe portion via a passage opening in a wall of the pipe portion, wherein the armature of the linear motor is arranged inside said additive outlet chamber and is configured to reciprocate inside said additive outlet chamber, thereby, in use, alternatingly compressing and decompressing a volume of said additive outlet chamber with a compression stroke and a decompression stroke, such that a compression stroke of said armature causes the additive to be directly injected from the additive outlet chamber through the passage opening into the pipe portion.

5. The injection assembly according to claim 1, wherein the linear motor is arranged between the pump portion and the pipe portion, the injection pump being arranged completely outside of the pipe portion.

6. The injection assembly according to claim 4, wherein the piston and the armature are directly coupled by a coupling member, such that when the additive outlet chamber is compressed, the additive inlet chamber is decompressed, and vice versa.

7. The injection assembly according to claim 1, wherein a second non-return valve is arranged between the reservoir and the additive inlet chamber, and wherein the first non-return valve is adapted to close during a compression stroke of the piston and to open during a decompression stroke of the piston.

8. The injection assembly according to claim 4, wherein the armature is covered by a fluid-tight armature cover and the additive outlet chamber is defined by a fluid-tight additive outlet chamber cover, and wherein a bypass channel is defined between the armature cover and the chamber cover.

9. The injection assembly according to claim 1, further comprising a flow sensor provided on the pipe portion and a controller, wherein the flow sensor is configured to measure the mass flow of the fluid inside the pipe portion.

10. The injection assembly according to claim 1, wherein the pipe and the pipe portion have a substantially equal diameter.

11. The injection assembly according to claim 3, wherein the first non-return valve comprises a resilient member, a ball, a seat, and a flow channel through the seat and around the ball, wherein, in a closed state of the first non-return valve, the seat receives the ball, such that the ball and the seat close the flow channel while the ball is pressed onto the seat by the resilient member and wherein, in an open state of the first non-return valve, the ball is moved away from the seat, such that the flow channel emerges between the seat and the ball.

12. The injection assembly according to claim 11, wherein said first non-return valve comprises a mechanical stopping member that restricts the movement of the resilient member in a direction away from the seat.

13. The injection assembly according to claim 11, wherein the seat and/or the resilient member are made from a synthetic rubber.

14. A method for the supply of a predetermined amount of an additive from a reservoir to a fluid in a pipe, using an injection assembly according to claim 1.

15. An injection pump comprising:

an electromagnetic linear motor comprising a stator and a movable armature that is configured to be driven reciprocatingly with respect to the stator, a pump portion comprising a piston and an additive inlet chamber, wherein the piston is coupled to the armature, and is configured to reciprocate in said additive inlet chamber, thereby, in use, alternatingly compressing and decompressing a volume of said additive inlet chamber with a compression stroke and decompression stroke, and an additive outlet chamber in direct fluid communication with a pipe portion and arranged in fluid communication with the additive inlet chamber; wherein, in use, a first decompression stroke of said piston discharges a predetermined amount of said additive from a reservoir into said additive inlet chamber, a consecutive compression stroke of said piston causes said additive to flow from the additive inlet chamber into the additive outlet chamber, and a consecutive second decompression stroke of said piston causes the additive to be directly injected into the pipe portion from the additive outlet chamber.

* * * * *